United States Patent [19]

Stapp

[11] 3,936,337

[45] Feb. 3, 1976

[54] APPARATUS AND PROCESS FOR THE MANUFACTURE OF STRUCTURAL MATS

[75] Inventor: Hans Stapp, Momlingen, Germany

[73] Assignee: Akzona Incorporated, Asheville, N.C.

[22] Filed: Dec. 16, 1974

[21] Appl. No.: 532,885

[30] Foreign Application Priority Data

Dec. 18, 1973 Germany ..... 2362856[U]
Dec. 18, 1973 Germany ..... 7344708[U]

[52] U.S. Cl. ..... 156/167; 156/181; 156/244; 156/441; 156/500; 264/168; 264/178 F; 428/222; 428/371

[51] Int. Cl.[2] ..... D04H 3/16

[58] Field of Search ..... 156/167, 181, 180, 244, 156/433, 500, 441, 72, 296, 306; 264/168, 178 F, 282; 425/66, 71, 131.5; 428/293, 222, 369, 371

[56] References Cited

UNITED STATES PATENTS

| | | | |
|---|---|---|---|
| 3,686,049 | 8/1972 | Manner et al. | 156/167 |
| 3,687,759 | 8/1972 | Werner et al. | 156/167 |
| 3,691,004 | 9/1972 | Werner et al. | 156/167 |
| 3,837,988 | 9/1974 | Hennen et al. | 156/167 |
| 3,852,152 | 12/1974 | Werner et al. | 156/167 |

*Primary Examiner*—Douglas J. Drummond
*Assistant Examiner*—Michael W. Ball
*Attorney, Agent, or Firm*—Johnston, Keil, Thompson & Shurtleff

[57] ABSTRACT

An apparatus and process for smoothing and densifying both the upper and lower surfaces of a filamentary mat or sheet as rows of freshly melt spun filaments are permitted to fall freely onto the surface of a liquid cooling bath whereby the individual filaments spread laterally at the bath surface to form helical to sinuous loops which then become self-bonded at overlapping points of intersection within a short distance below the bath surface. A flattening or densifying of upper and lower surfaces of the mat into a more rigid structural member is accomplished by inserting at least one pair of downwardly diverging plates within the bath such that the upper apex thereof extends parallel to the rows of filaments and falls within at least one outermost row of filaments, thereby deflecting such a row inwardly and upwardly over the apex as it is incorporated into an outer bonded surface of the mat.

10 Claims, 5 Drawing Figures

APPARATUS AND PROCESS FOR THE MANUFACTURE OF STRUCTURAL MATS

A process for producing a resilient mat or cushion composed of rows of helically to sinuously looped and self-bonded filaments has been described in U.S. Pat. No. 3,687,759, and because this prior process represents the essential point of departure of the present invention, said patent is incorporated herein by reference as fully as if set forth in its entirety. In principle, the patent discloses a molten thermoplastic polymer being spun in the form of amorphous filament strands from a spinning nozzle for free fall onto a cooling bath, preferably water. The vertically spun continuous filament coil into laterally spread loops on the bath surface due to the upward buoyant force of the cooling liquid. These laterally coiled loops adhere to each other upon contact at overlapping points of intersection during the cooling process at or just below the bath surface. This coherent mat of looped filaments is drawn downwardly into the bath and continuously pulled out after being solidified. The resulting mat or cushion has parallel rows of predominately helically to sinuously looped filaments resembling a spring cushion with the axes of the springs extending parallel to the sides or outer surfaces of the mat. Mats or cushions manufactured in this manner have irregularly shaped outer surfaces caused by the filament loops being positioned perpendicularly to these surfaces.

A further process has been disclosed in U.S. Pat. No. 3,691,004 whereby at least one surface of such a mat is flattened or densified by bringing the vertically spun filaments of an outermost row in contact with an inclined plate simultaneously with the submersion of the filaments into the bath, this plate intersecting the bath surface at an angle of 10° to 80°. It is recommended by the patent that the intersecting line of the bath surface and the plate be positioned approximately along the line projected on the bath surface by the outermost row of the freshly spun filaments. The result of bringing the filaments in contact with the plate and the bath surface was to rearrange or deform the loops making up the outermost filament rows so as to extend horizontally in the plane of the mat surface. One mat surface thereby became smooth and exhibited a higher density than the rest of the mat.

The possibility of achieving a mat with two flat surfaces was also explained in U.S. Pat. No. 3,691,004. For this purpose, the mat being formed was to be brought into contact with the supporting plate on one side while simultaneously being put under light pressure from the opposite side by means of a rotatable roller. This roller, being submerged in the solution, caused frequent disturbances, especially due to the unfavorable circulation of the bath liquid which affects the formation of the loops and the mat in an adverse manner.

The use of two opposing rollers or plates has also been suggested but without achieving satisfactory results.

One object of the present invention is to provide a process and an apparatus for the manufacturing of filamentary mats or sheets having either one or two flat and densified surfaces while avoiding the disadvantages of a rotating roller. It is especially an object of the invention to provide a process and apparatus which maintains a uniform helical to sinuous looping of filaments in regular parallel rows inside of the mat being formed while flattening and filling in one and preferably both outer surfaces, thereby offering smooth outer surfaces which can be made much more rigid in the form of a structural mat or sheet. These and other objects and advantages will become more apparent from the following detailed disclosure.

It has now been found in accordance with the invention, that one can continuously melt-spin and produce a generally open-structured thermoplastic filamentary mat with much more highly densified and reinforced upper and/or lower mat surfaces by providing a precise variation in the path of the corresponding outermost row or rows of the freshly spun molten filaments as they are received for loop formation on the bath surface and then joined to the body or intermediate rows of the remaining melt-spun and looped filaments. The conventional steps are followed in part and include melt-spinning continuous thermoplastic polymer filaments vertically downwardly in a plurality of rows onto the surface of a liquid cooling bath which exerts a sufficient buoyant force to laterally spread the individual filaments at the bath surface into helical to sinuous loops which become self-bonded at overlapping points of intersection of adjacent filaments within a bonding zone lying a short distance below the bath surface and then withdrawing the resulting coherent mat from the bath. The improvement in the process of the present invention includes the steps of at least slightly compressing the mat between opposing stationary guide surfaces as it is withdrawn from said bonding zone; and contacting an outermost row or rows of filaments corresponding to at least one of the upper and lower surfaces of the mat with a second stationary guide surface which diverges outwardly from one of said first-mentioned guide surfaces to extend for at least a short distance below the bath surface such that at least one outermost row of filaments is deflected in a path inwardly and upwardly over an apex and then downwardly on said first-mentioned quide surface so as to be incorporated into the formation of an outer bonded and flattened surface of the mat.

Especially good results have been achieved in the process of the present invention when using a linear fiber-forming polyamide (nylon 6 or nylon 6,6) or polyester (polyethylene terephthalate) for spinning substantially amorphous filaments, preferably onto the surface of a water or aqueous cooling bath. However, it is feasible to process other well-known thermoplastic filaments in this same manner, e.g. polyolefins or polyvinyl chloride.

In carrying out the generally known steps of this new process, it is possible to follow the same procedures or combine features used in both of the above-noted U.S. Pat. Nos. 3,687,759 and 3,691,004 so that the latter of these two patents is also to be included herein by reference as fully as if set forth in its entirety. Suitable variations or especially preferred conditions and features of the present invention are explained more fully below.

Apparatus which is especially suitable for purposes of the present invention as well as the process carried out therewith will be described in conjunction with the accompanying drawing in which.

Similar parts are designated by similar reference numerals in each of the figures of the drawing, it also being understood that the process is carried out in substantially the same manner in spite of variations in the construction or arrangement of the apparatus.

Figure 2:
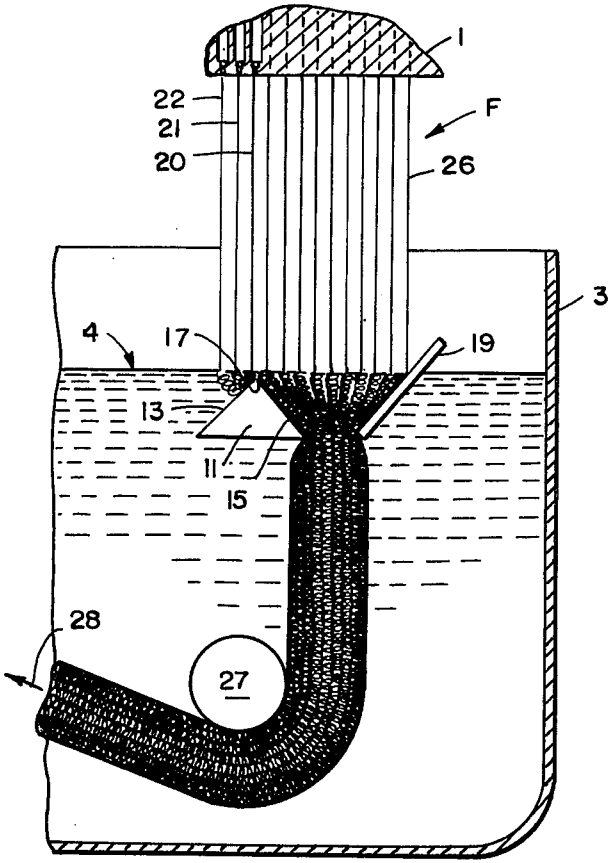
FIG. 2 is a similar illustration of another useful embodiment combining the special guide member of the present invention with the previously suggested inclined plate guide.
Figure 1:
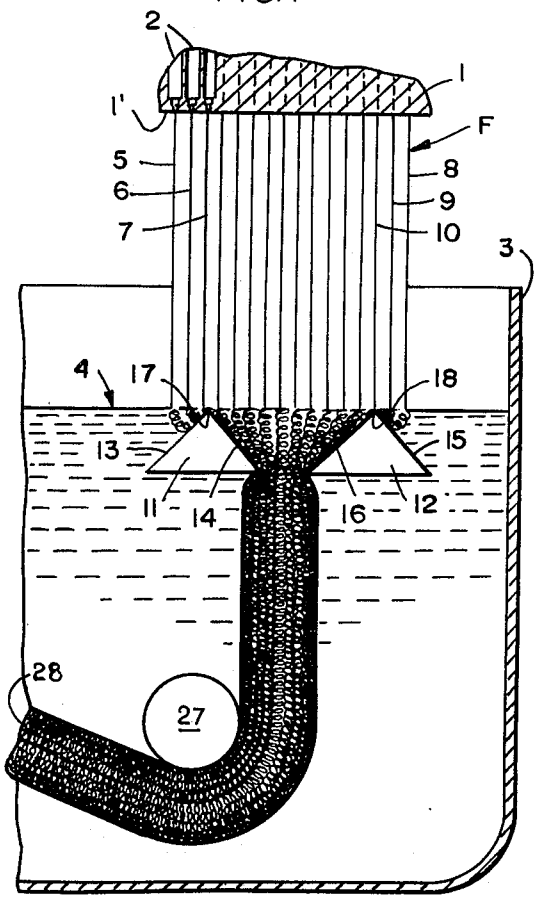
FIG. 1 is a partly schematic view illustrating an especially advantageous arrangement of the required spinning head and bath containing special guide members in accordance with the invention.

Referring first to FIGS. 1 and 2, a spinning head 1 containing a plurality of spinning nozzles 2 in sixteen rows is positioned above a spinning tank or cooling bath vessel 3 such that the distance or gap between the face 1′ of the nozzle plate and the bath surface 4 is about 20 mm., the filaments F falling freely over this gap so as to be melt spun vertically in a substantially amorphous state onto the bath surface. Due to the buoyancy effect of the liquid cooling medium, preferably water, the individual filaments form laterally spreading helical to sinuous loops at the bath surface, these loops preferably overlapping with each adjacent filamentary loop so as to become bonded to each other at their points of intersection (FIG. 2) although it is feasible for the rows to be separated sufficiently so that there is no initial overlapping from row to row (FIG. 1). The rows of filaments F in the drawing are viewed in each case from one end or as a cross-section perpendicular to the mat or sheet being produced.

For purposes of the present invention, it is preferable to provide a gap between the nozzle face 1′ and the bath surface 4 of about 4 to 20 cm. The individual spinning nozzles are ideally positioned at equal distances in a plurality of parallel rows, preferably staggered from one row to the next, with a distance between each filament from side to side and preferably from row to row of at most 15 mm. and preferably about 4 to 8 mm. Such dimensions normally permit the overlapping of each helically to sinuously looped filament with its adjacent filaments, i.e. from row to row and from side to side. Within reasonable limits, variable spacing can be used between spinning nozzles or their corresponding filaments in each row as compared to the distance from row to row. However, equal spacing is desirable so that the distance between the rows themselves is less than the distance between the nozzles or filaments in each row. A nozzle or filament spacing of less than 3 – 3.5 mm. usually will not yield satisfactory results, even with an extremely fine filament of about 0.1 mm. in diameter.

The width of the mats being formed is variable within a very broad range and essentially depends only on the end use of the structural mat. Likewise, the thickness of the mat may be varied within relatively broad limits although a minimum of about five and preferably at least eight rows of filaments is usually desirable to provide both outer dense surfaces and a much more open and three-dimensional helical to spiral filament structure in the center of the mat.

These various intervals may be readily adjusted in a routine manner, depending upon the polymer being spun, its diameter and the temperature of the spun filaments, so as to achieve the desired helical to sinuous looping with a lateral extension of the loops at or just below the bath surface sufficient to permit overlapping and self-bonding, e.g. as though adjacent coil springs were to be abutted and adhered to each other.

In order to provide a deflected path for at least one of the outermost rows of filaments, for example approximately the first three rows of filaments 5,6,7 and 8,9,10 on each side of the mat, two triangular shaped guide members 11 and 12 having downwardly diverging plates or guide faces 13,14 and 15,16 (respectively) are positioned in the bath vessel 3 so that the upper apex or joint line of these plates 17 and 18 in each instance is parallel to the rows of filaments and falls just inside the third outermost row of filaments 7 and 10.

In FIG. 1, the inner converging plates or guide faces 14 and 16 opposing each other are at an angle of about 45° to the bath surface and provide a narrowing intermediate compression zone in the bath extending downwardly from the bonding zone. Once the looped filaments are bonded, they still are sufficiently hot and plastic to be further deformed and flattened as they are withdrawn in contact with the opposing guide faces 14 and 16. However, if the three outermost rows 5,6,7 and 8,9,10 were to be omitted, the resulting flat surfaces still tend to be relaitvely open and inadequately reinforced in terms of the desired use as a structural mat or sheet.

Therefore, it is essential to provide at least one and preferably two up to about eight outermost rows which first contact the bath surface 4 with the usual loop formation, but then come in contact with the outer or outwardly diverging guide faces 13 and 15 so as to be deflected upwardly thereon over the apex 17 and 18 in each instance and only then incorporated into the formation of the flattened and bonded upper and lower surfaces of the mat under the influence of the opposing guide faces 14 and 16.

The upper apex 17 and 18 of the individual guide members 11 and 12, while preferably being positioned from about the second to eighth outermost row of nozzles or filaments (counting from the outside row inwardly) and being parallel to these rows and the bath surface, should ordinarily be positioned not more than about 5 mm. below the bath surface and is preferably within or very close to the plane of the bath surface. One row of filaments can be permitted to fall very close to this apex and/or the path of the filaments as they are deflected over the apex may even penetrate the bath surface.

The apex angle or angle of divergence of the two guide surfaces 13,14 or 15,16 may be from about 20° up to as much as 160° while the inner opposing surfaces 14 and 16 will usually be placed at an inclined angle of about 10° to 80° with respect to the bath surface 4. relatively The following working example, based upon the apparatus, illustrated in FIG. 1, will serve to provide an especially preferred embodiment of the process according to the invention and its resulting product.

EXAMPLE 1

In this case, both the upper (left-hand) and the lower (right-hand) surfaces of the mat as it is shown in FIG. 1 are formed equally to provide the same density.

| | |
|---|---|
| Filament material: | Nylon-6. |
| Nozzle plate: | 4669 nozzle bores in 29 rows, |

-continued

| | |
|---|---|
| | 161 bores each. |
| Space between bores: | 5 mm. |
| Space between rows: | 4.35 mm. |
| Bore (orifice) diameter: | 500 μm. |
| Distance from nozzle plate to bath surface: | 20 cm. |
| Width of mat: | 800 mm. |

The triangular guide members 11 and 12 are constructed so that the diverging guide faces are inclined in each instance at an angle of 60° to the bath surface so that the apex angle is also 60°. Each apex 17 and 18 is located at the bath surface or only very slightly below the surface, and each apex is positioned vertically below the fourth row of nozzle bores or spinning openings from the outer sides, leaving 21 rows therebetween. However, about the first three of these intermediate rows also become flattened so that the denser structure is made up of approximately seven rows along the upper and lower surfaces of the mat, respectively, and the remaining fifteen rows in the middle are relatively uniformly looped in the nature of predominately helical to sinuous loops or coils extending in parallel adjacent overlapping and self-bonded rows. The density of these fifteen inner rows is relatively homogeneous so as to provide a lightweight structure with flat, smooth, outer reinforcing surfaces of much higher density than is possible with the same number of rows flattened only beginning with the outermost row.

Not only do the deflected three or four outermost rows become strongly bonded and incorporated into the upper and lower mat surfaces, but also there is evidence that the initially forming loops tend to become more deformed so as to spread more evenly over the outer mat surfaces to give a much more even or smooth appearance. This effect may also be accompanied by some degree of orientation along the outer surfaces of the formed mat so that one achieves an even further strengthening or reinforcement with the upper and lower mat surfaces. Depending upon the number of rows of filaments involved, one may observe three stages or variations in density proceeding from the outermost portions to the interior of the mat or sheet structure.

In the next working example, carried out with the apparatus of FIG. 2, a very similar process is carried out but using only a single plate guide member 13 for the upper surface while introducing a single inclined plate guide 19 intersecting the bath along the outermost row at the bottom surface of the mat being formed.

EXAMPLE 2

In this case, the upper surface is provided with a greater density than the bottom surface which is nevertheless more dense than the interior of the mat.

The same polyamide, i.e. nylon-6, is used as in Example 1 and is melt spun from the same nozzle plate with all features and conditions being the same except the type and position of the guide elements:

Upper Surface

The same triangular guide member 13 in this instance is placed with its apex 17 at the bath surface but under the third row of nozzle bores or spinning openings corresponding to filament 20. The outermost two rows 21 and 22 are thus deflected upwardly over the apex 17 as in Example 1, and a relatively dense upper surface is thereby formed from about the first five rows of filaments and has a thickness of about 1.5 mm.

Lower Surface

The plate 19 is inclined at an angle of 45° to the bath surface 4, intersecting this surface along the outermost row 26 of the spun filaments as spun from the corresponding last row of nozzles in the spinning head 1. The narrowest interval between plate 19 and the inner opposing guide face 15 of member 11 is 10 mm. This guide plate, as also used in U.S. Pat. No. 3,691,004, caused a slight increase in density over the outermost thirteen rows of filaments corresponding to the bottom surface of the mat with compression of this surface to a thickness of about 2.5 mm. The overall thickness of the mat amounted to about 20 mm. By comparison to Example 1, both outermost surfaces of the finished mat were either less thick or less dense and less satisfactory as a smooth reinforcing surface layer, especially when using only the inclined plate 19.

In both of the foregoing examples and in other similar embodiments, the initially formed and surface-flattened mat is drawn off from the bath around a guide roll or guide cylinder 27 in the direction of the arrow 28 by any suitable take-up means. The draw-off speed is preferably about the same as the speed at which the mat is formed, i.e. without placing excess tension on the mat or drawing it out. On the other hand, a minimal drawing out of the dense surface portions to provide linear orientation and greater strength is possible to the extent that the interior self-bonding of the looped filaments is not seriously impaired.

Figure 3:
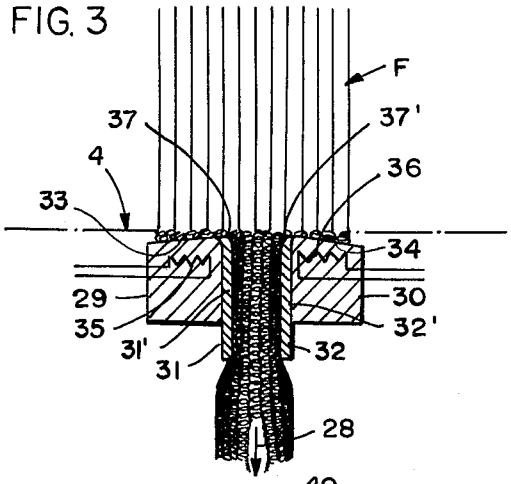
FIG. 3 is a partial schematic view of still another useful arrangement of the special guide members in a slightly different embodiment of the invention.

Yet another useful embodiment is that shown in FIG. 3 in which the guide blocks or members 29 and 30 support the inner guide plates 31 and 32 providing the elongated guide surfaces 31' and 32', respectively, in vertical or nearly vertical positions and parallel to each other. The outwardly diverging legs or deflecting guide surfaces 33 and 34 are at a relatively shallow angle with reference to the bath surface, but follow the same principle in terms of the position of the apex formed at the top of the plates. In this case, the outermost filaments are channeled upwardly and over the apex in a sufficient volume to still cause a certain degree of compression between vertical surfaces 31 and 32 while tending to even further draw out the initial loops of the outermost deflected rows of filaments. The guide blocks 29 and 30 may also be heated along one or both guide surfaces, for example with electrical heating elements 35 and 36, in order to ensure the plasticity or deformability of the filaments being incorporated and flattened along the top and bottom surfaces of the mat.

In FIGS. 1 and 2, the diverging guide surfaces 13, 14 or the like are usually made of flat plates or surfaces which meet along a single edge, apex or intersection line at the required angle. On the other hand, as shown in FIG. 3, this apex 37 and 37' may have a convex rounded shape to facilitate the movement of the outermost filaments as they are drawn inwardly over the apex and down along the outer mat surfaces.

Figure 4A:
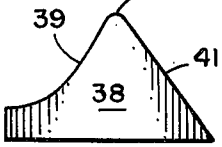
FIGS. 4a and 4b are segmental views of the left-hand portions of still other variations of the guide members of the invention.
Figure 4B:
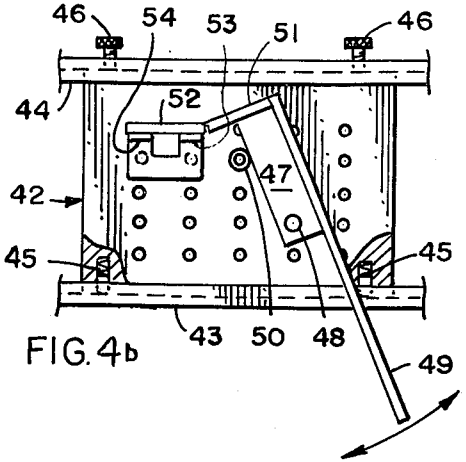

Still other useful embodiments are shown in FIGS. 4a and 4b in providing different forms of left-hand guide members which are advantageous in extending or limiting the distance below the bath level and/or the inclination of the guide surfaces. It will be understood that a right-hand guide member (not shown) is always used therewith, usually as the mirror image in shape.

FIG. 4*a*, for example, shows a left-hand guide block 38 with a concave guide surface 39 extending downwardly away from the apex 40. The inclined guide surface 41 which faces or compresses the mat has a flat or even shape as in FIGS. 1–3.

FIG. 4*b* illustrates how one may use several small plates or bars in a large number of adjustable positions so that both the inclination and depth of the guide surfaces can be changed in producing different mat structures or in using different types of thermoplastic polymers. A pegboard type of supporting member 42 can be placed on either side of the spinning head, e.g. fastened to the walls of the bath vessel, preferably for horizontal movement along the rails 43,44. It is also preferable to provide means for a slight accurate vertical adjustment of support 42 within about 5 mm. of the bath surface, for example by using the spring loaded pins 45 on the bottom rail 43 to urge the member 42 upwardly against set screws 46 in top rail 44. The larger bar or cross-piece 47 is pivoted on its own end pins 48 fitted in member 42 so that the attached and interchangeable inner guide plate 49 may be set at any desired inclination to the bath surface, e.g. with the aid of a stop pin block 50 or the like. The deflecting surfaces for the outermost looped filaments are provided by additional small plates 51 and 52 so as to provide a concave type surface similar to the curved surface of FIG. 4*a*. These small plates 51 and 52 may be mounted on brackets 53 and 54, respectively, such brackets having their own pins to fit the pegboard member 42.

The above-described forming and shaping apparatus and other suitable variations thereof may be very easily constructed and assembled for use with conventional spinning heads and bath vessels. All parts remain stationary in the bath so that waves, ripples or other disturbances are kept to a minimum and the individual loops of the filaments can be formed at and just below the bath surface to achieve an ideal helical to sinuous configuration as they are brought together into the mat or sheet being manufactured.

The guide surfaces, i.e. both the inwardly facing surfaces contacting the mat and the outwardly diverging surfaces for deflecting the outermost filaments, are preferably constructed of metal with a smooth and usually polished surface. They may be coated to prevent sticking of the hot or still tacky polymer and they may also be heated as shown in FIG. 3 or by using hollow blocks heated with steam or similar heating fluids.

By changing the length of the guide surfaces or their relative position below the bath surface, a further variation in density can be achieved in the inner or middle portion of the mat as well as in the upper and lower surfaces. Thus, it will be found that the thickness of the homogeneous middle portion of the mat increases proportionately as the compression is reduced, for example by increasing the angle of inclination of the inner guide surfaces with reference to the bath level. While the diameter of the nozzle bores and their side-by-side spacing as well as the row spacing are used to determine the basic structure of the mat, the distance below the bath surface and the angle of inclination of the guide surfaces has a definite influence on the density of the outer mat surfaces. In general, one begins with the desired diameter of the individual filaments and then adjusts the remaining parameters.

One and preferably both upper and lower surfaces of the mat are produced with the use of the outer deflecting guides as well as the inner opposing guides to maximize the density and rigidity of these surfaces. However, it is quite feasible to achieve this desired effect on only one of the upper and lower surfaces so that the other surface has a substantially different density. A variation in the density of the two surfaces may also be achieved by varying the number of outermost filaments or the length and/or inclination of the outer guide surfaces. In this latter case, one can vary the density while still achieving the desired high density and relatively greater reinforcing strength in both surfaces.

Mats produced in accordance with the present invention, especially with both upper and lower surfaces being relatively smooth and dense, are useful as structural members for many different purposes. For example, they can serve as synthetic. light weight construction panels for non-supporting walls. They are further useful as acoustical tiles, insulating panels, partitions, false ceilings, packaging materials, display panels and the like. These mats or sheets can be made in continuous lengths with practically any desired thickness and, depending on their flexibility or resilience, may also be used as floor coverings or underlaying support mats.

With the wide variations of sandwich type structure and density provided by the present invention, there are many applications for the mats in industry and commerce where it is essential to combine smooth, dense surfaces of reasonable strength or rigidity with an open-looped and self-bonded filamentary core. The process of the invention is especially advantageous because no bonding agents are required and it is unnecessary to make separate layers and then laminate in different steps. At the same time, the apparatus used is inexpensive and has no moving parts.

All of these features offer an opportunity to obtain mats of a novel and very useful structure, best characterized as a unitary, coherent mat consisting essentially of a helically to sinuously looped open core and upper and lower or outer enclosing surfaces formed by flattened and intermingled looped filaments of a density of at least twice and preferably 4 to 5 times that of the core. Even more preferred is at least one outer surface or both upper and lower surfaces having a density of more than 4 or 5 times that of the inner open core. Polyamide (nylon) filaments are especially useful, and the structural mats of the invention can be made of such a fiber-forming polymer or similar polymers to provide great durability with extended use. The filaments may also be dyed or pigmented. If desired, other layers may be easily applied to the smooth surfaces of the mats, e.g. wood panels, metal foils, paper and the like. Other end uses and variations or additions in structure to the mats will be suggested by the foregoing discussion of the new mats and their particular method of production.

The invention is hereby claimed as follows:

1. In a process for the manufacture of a structural mat by melt-spinning continuous thermoplastic polymer filaments vertically downwardly in a plurality of rows onto the surface of a liquid cooling bath which exerts a sufficient buoyant force to laterally spread the individual filaments at the bath surface into helical to sinuous loops which become self-bonded at overlapping points of intersection of adjacent filaments within a bonding zone lying a short distance below the bath surface and then withdrawing the resulting coherent mat from the bath, the improvement which comprises:

at least partly compressing the mat between opposing stationary guide surfaces as it is withdrawn from said bonding zone; and contacting at least one of the outermost rows of filaments corresponding to at least one of the upper and lower surfaces of the mat with a second stationary guide surface which diverges outwardly from one of said first-mentioned guide surfaces at a short distance below the bath surface such that said at least one outermost row of filaments is deflected in a path inwardly and upwardly over an apex onto said one of said first-mentioned guide surfaces so as to be incorporated into an outer bonded and flattened surface of the mat.

2. A process as claimed in claim 1 wherein the filaments are composed of a linear fiber-forming polyamide.

3. A process as claimed in claim 1 wherein the filaments are composed of a linear fiber-forming polyester.

4. A process as claimed in claim 1 wherein said at least one outermost row of filaments is deflected over an apex located substantially within the bonding zone of the liquid cooling bath.

5. A process as claimed in claim 1 wherein the outermost rows forming both the upper and lower surfaces of said mat are respectively contacted with second guide surfaces so as to be incorporated into the upper and lower bonded and flattened surface of the mat.

6. A process as claimed in claim 1 wherein said filaments have a diameter of about 0.1 to 1.5 mm., and are melt spun over an air gap of about 2 to 30 cm. onto the bath surface in parallel rows with the distance between adjacent rows and adjacent filaments being not more than 15 mm. and said apex is not more than about 5 mm. below the surface of the liquid cooling bath.

7. A process as claimed in claim 6 wherein the path of deflection of said at least one outermost row of filaments forms an angle of about 20° to 160° in passing from the second to the first of said guide surfaces.

8. In apparatus for the manufacture of a coherent structural mat of parallel rows of continuously looped thermoplastic filaments with the mat being flattened and densified on both its upper and lower surfaces, the improvement in combination with a spinning head having a plurality of parallel rows of spinning nozzles to melt-spin said filaments, a cooling bath means to receive and helically to sinuously loop the filaments and means to withdraw the mat from the bath which comprises:

opposing stationary guide plates converging downwardly toward each other below the bath surface and intersecting the bath surface in a line parallel to the filament rows to provide means to compress the mat therebetween to form its upper and lower surfaces;

at least one additional stationary guide plate diverging downwardly and outwardly from one of said first-mentioned guide plates to form an apex therewith in a line positioned at or below the bath surface parallel to and falling within at least one outermost row of filaments falling vertically down from said spinning nozzles such that said at least one outermost row of filaments is drawn inwardly and upwardly on said additional guide plate over the apex and then downwardly between the two opposing guide plates.

9. Apparatus as claimed in claim 8 wherein said spinning nozzles are positioned about 2 to 30 cm. above the bath surface to provide filaments having a diameter of about 0.1 to 1.5 mm., the distance between adjacent rows and adjacent nozzle openings being not more than 15 mm. and the apex formed by said additional guide plate with said first mentioned guide plate providing said compressing means is located not more than about 5 mm. below the surface of the bath.

10. Apparatus as claimed in claim 9 wherein the angle of divergence between said additional guide plate and said first-mentioned guide plate is about 20° to 160°.

* * * * *